US007461416B2

(12) United States Patent
Stover

(10) Patent No.: US 7,461,416 B2
(45) Date of Patent: Dec. 9, 2008

(54) PORTABLE SPA HEATER

(76) Inventor: John J. Stover, 212 Ross Ave., New Cumberland, PA (US) 17070-2614

( * ) Notice: Subject to any disclaimer, the term of this patent is extended or adjusted under 35 U.S.C. 154(b) by 187 days.

(21) Appl. No.: 11/436,627

(22) Filed: May 19, 2006

(65) Prior Publication Data

US 2006/0260036 A1 Nov. 23, 2006

Related U.S. Application Data

(60) Provisional application No. 60/682,867, filed on May 20, 2005.

(51) Int. Cl.
*E04H 4/00* (2006.01)

(52) U.S. Cl. ..... 4/507; 4/598; 4/493; 4/506; 4/545

(58) Field of Classification Search ..... 4/598, 4/493, 506, 507, 545
See application file for complete search history.

(56) References Cited

U.S. PATENT DOCUMENTS 4,594,500 A * 6/1986 Wright ..... 4/493
4,855,569 A * 8/1989 Wiedemann ..... 4/493
4,924,069 A * 5/1990 Giordani ..... 4/493
4,947,025 A * 8/1990 Alston et al. ..... 392/481
5,095,559 A * 3/1992 Liljegren et al. ..... 4/541.2
5,172,754 A * 12/1992 Graber et al. ..... 4/545
5,199,116 A * 4/1993 Fischer ..... 4/541.2
5,283,915 A * 2/1994 Idland et al. ..... 4/506
5,408,707 A * 4/1995 Wilson ..... 4/506
5,524,820 A 6/1996 Regan
5,606,964 A * 3/1997 Bussman ..... 4/493
6,357,059 B1 * 3/2002 Lau ..... 4/506
D486,896 S 2/2004 Long et al.
2002/0020014 A1 2/2002 Authier
2002/0050490 A1 5/2002 Pittman et al.
2003/0070215 A1 * 4/2003 Chung ..... 4/420.4
2003/0097710 A1 5/2003 Adrian

* cited by examiner

*Primary Examiner*—Khoa D Huynh
(74) *Attorney, Agent, or Firm*—Richard C. Litman

(57) ABSTRACT

A portable water heating system for use with a spa. The heating system circulates water from a spa, heats the water and returns the heated water to the spa. The portable heating system includes a housing that encloses a heater and a pump; a water intake hose; a water outlet hose; and a thermostat. The heating system may also include temperature-setting dials and flow and pressure regulating switches. A thermostat is also disposed within the portable spa heating system and is attached to the heater. The thermostat may be set to a predetermined temperature so that the heater, and therefore water temperature, may be controlled.

2 Claims, 3 Drawing Sheets

PORTABLE SPA HEATER

CROSS-REFERENCE TO RELATED APPLICATION

This application claims the benefit of U.S. Provisional Patent Application Ser. No. 60/682,867, filed May 20, 2005.

BACKGROUND OF THE INVENTION

1. Field of the Invention

The present invention relates to spa heaters, and particularly to a portable spa heating system.

2. Description of the Related Art

Maintenance of home spas is often a cumbersome task for the spa owner. Spa owners may not use the spa enough during cold winter months. When this happens, water in the plumbing or the tub itself may freeze. After such freezing has occurred, technicians are generally required to come to the user's home in order to defrost the spas. Repair technicians do not generally have an easy method of thawing the spa. Often, a high BTU heater is used that is directed into a spa pack to thaw the spa and the spa plumbing. These heaters are not light and easy to carry.

The problem that occurs is that a technician is required to be present the entire time is takes to thaw the plumbing and the spa. Safety concerns necessitate the presence of the technician the entire time so that the heater does not overheat. This results in wasted time for the technician and the repair company and great expense to the spa owner for the technician's time. Due to the expense involved, many spa owners are told to wait until the weather is warmer to thaw their spas. However, extensive damage may be done to the spa and the spa plumbing, heater and pumps because ice may expand and crack the equipment.

Accordingly, there is a need for a portable spa heating system that defrosts a frozen spa, eliminates the need for the technician to remain at the spa site for extended amounts of time, may be easily transported to the spa itself. Thus a portable spa heating system solving the aforementioned problems is desired.

SUMMARY OF THE INVENTION

The portable spa heating system is a portable unit for use with a spa. The heating system circulates water from a spa within the housing of the system, heats the water and returns the heated water to the spa. The portable heating system includes a housing with an enclosed heater and pump; a water intake hose; a water outlet hose; and a thermostat. The heating system may additionally include temperature-setting dials, and flow and pressure regulating switches.

The pump and the heater, located within the housing, are connected to each other. The water intake hose and the water outlet hose extend through the housing of the spa heating system and out to the spa, where the hoses are placed within the spa reservoir. The intake hose is connected to the pump. The pump draws water from the spa through the intake hose, and the water is circulated from the pump to the heater, where the water is heated and is then discharged out of the heater through the water outlet hose. The water is then circulated back into the spa reservoir.

A thermostat is disposed within the housing of the portable spa heating system and is attached to the heater to sense the temperature of water flowing through the heater. The thermostat has a display on the outside of the housing to permit the technician to take readings of the water temperature. The thermostat may be set to a predetermined temperature, and when the specified temperature of the water is reached, the heater is either shut off entirely or shut off until the temperature falls below a specified amount.

Flow and pressure switches may also be attached to the pump as an added safety measure so that if the water pressure is not high enough, the heater may be turned off or adjusted accordingly.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
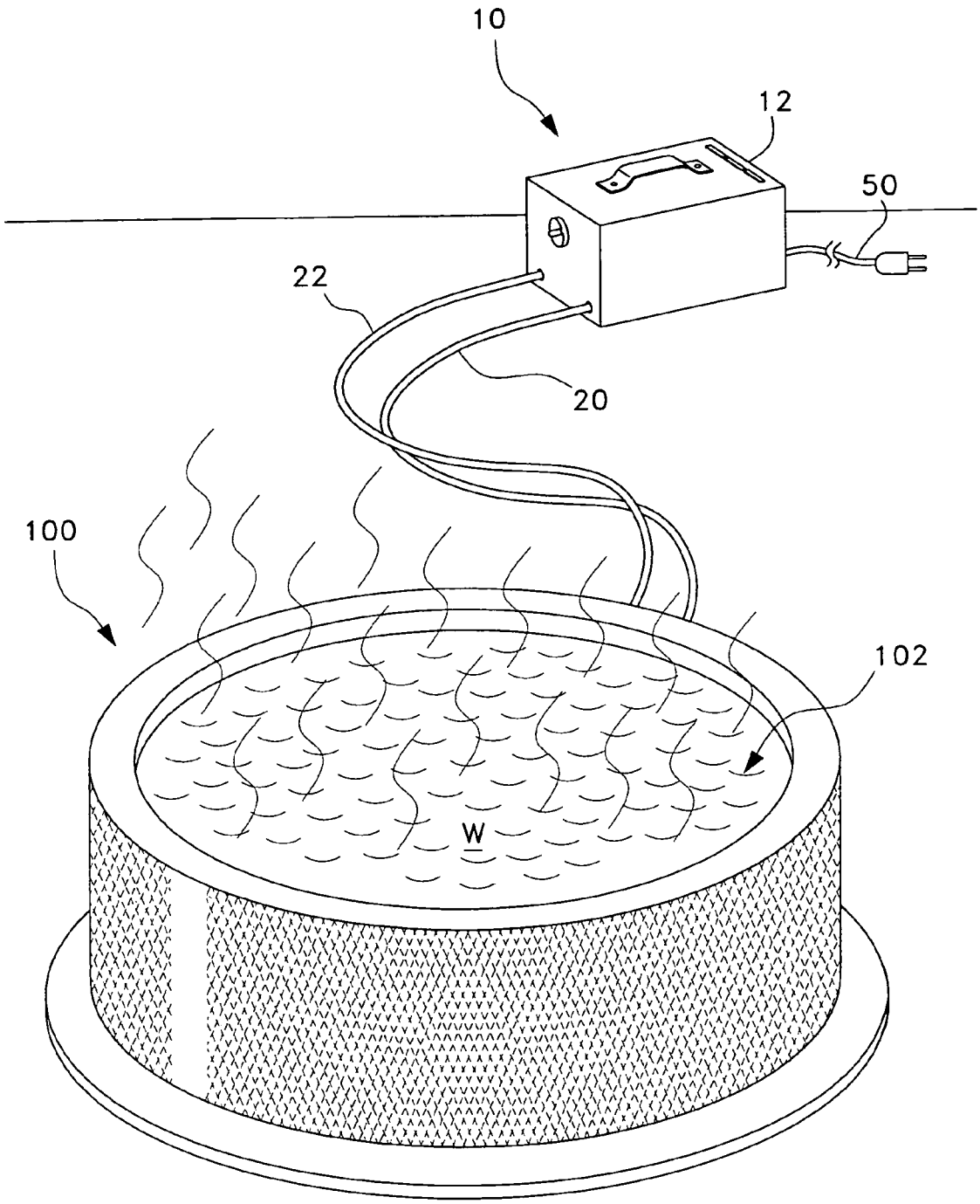
FIG. 1 is an environmental, perspective view of a portable spa heating system according to the present invention.

The present invention is a portable spa heating system that is used for heating water held within the water reservoir of the spa. The portable spa heating system, designated generally as 10 in the drawings, is able to thaw a semi-frozen spa and raise the water to a specified temperature.

Referring first to FIG. 1, an environmental perspective view of the portable spa heating system 10 is shown. The portable spa heating system 10 is adapted for use with a spa 100. The spa 100 is a typical standalone structure having a water reservoir 102 that holds water W. The portable spa heating system 10 includes a housing 12 that encloses a heater 14 and a pump 16 (shown more clearly in FIG. 2). The housing 12 may be made from numerous materials, including plastic, aluminum or metal. The spa heating system 10 also includes a water intake hose 20 and a water outlet hose 22, both of which extend out of the housing 12 of the spa heating system 10 to the spa 100. The heating system 10 includes an electric cord 50 that may be plugged into an outlet to provide electricity to the portable spa heating system 10.

Figure 2:
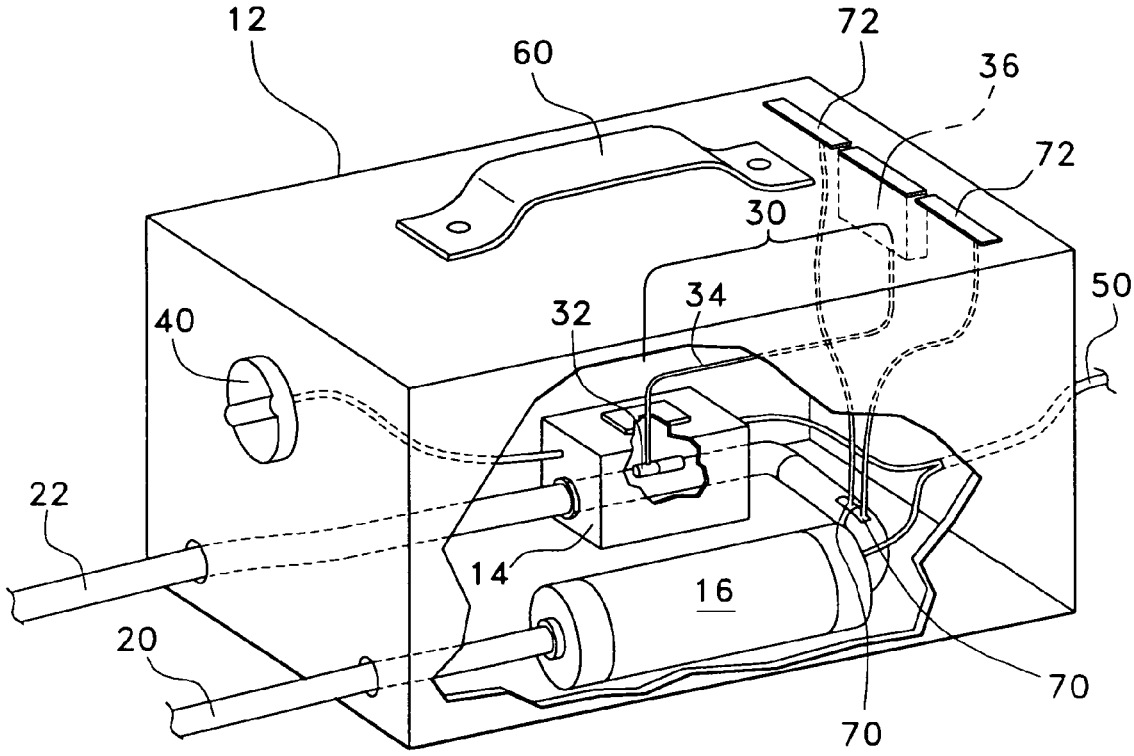
FIG. 2 is a perspective view of the portable spa heating system according to the present invention with the housing broken away to show components disposed within the housing.

Turning now to FIG. 2, there is shown a perspective view of the portable spa heating system 10. A heater 14 and a pump 16 are disposed within the housing 12. The heater 14 may be any type of water-heating system; for example, the water may flow through the heater 14 and a heating element may be disposed inside the tube through which the water flows so that the water may be heated. The water intake hose 20 and the water outlet hose 22 extend through the housing 12 of the portable spa heating system 10 and out to the water reservoir 102 of the spa 100. The intake hose 20 is connected to the pump 16 within the housing 12 of the portable spa heating system 10. The outlet hose 22 is connected to the heater 14 within the housing 12 of the portable spa heating system 10.

The pump 16 pumps water from the spa 100 through the intake hose 20 and into the housing 12 of the portable spa heating system 10. The water is discharged from the pump and flows through the heater 14. Heated water is returned to the spa 100 through the outlet hose 22.

The electric cord 50 is adapted to access an electrical outlet and extends into the housing 12 of the portable spa heating system 10. The electric cord 50 may be split once within the housing 12 and connected to the heater 14 and the pump 16 so that the heater 14 and pump 16 may be operated.

A thermostat 30 is disposed within the housing 12 of the portable spa heating system 10. The thermostat 30 is connected to the heater 14 to sense the temperature of water flowing through the heater 14, and regulate power to the heating elements and/or pump 16. Thermostat information is displayed on a thermostat display 36 attached to the housing 12 of the portable spa heating system 10. The thermostat 30 may be any typical thermostat 30 for measuring the temperature of water and regulating power to the heater 14, and possibly to the pump as well.

The thermostat 30 may have a sensing element 32, such as a bulb, that is placed within the heater 14 adjacent the tubing of the outlet hose 22 so that the thermostat 30 may accurately gauge the water temperature of water flowing through the heater 14. A cord 34 is part of the thermostat assembly 30 and extends from the sensing element 32 to the thermostat display 36. The thermostat 30 may be set in such a manner that the heater 14 is shut off when a specified temperature is reached, for example, a maximum temperature of 104° Fahrenheit. A dial 40 or other such temperature-controlling means may be attached to the outside of the housing 12 and to the heater 14, allowing for a user to regulate the temperature to which the water is heated.

Flow or pressure sensors 70 may be attached to the system conduit as an added safety measure. The flow and pressure sensors 70 are connected to the conduit extending between the pump 16 and the heater 14 to determine the amount of water flowing into the heater 14. If the water pressure is too low, the sensors 70 trigger switches that prevent the heater 14 from turning on. Indicator lights 72 may be attached to the housing 12 and used to determine the status of the flow of the water.

A handle 60 is affixed to the top of the housing 12 of the portable spa heating system 10 for carrying the housing 12.

While the hoses 20 and 22 are shown being inserted within the water reservoir 102 of the spa 100, the hoses 20 and 22 may also be adapted to engage the filter intake (not shown) of the spa 100.

Figure 3:
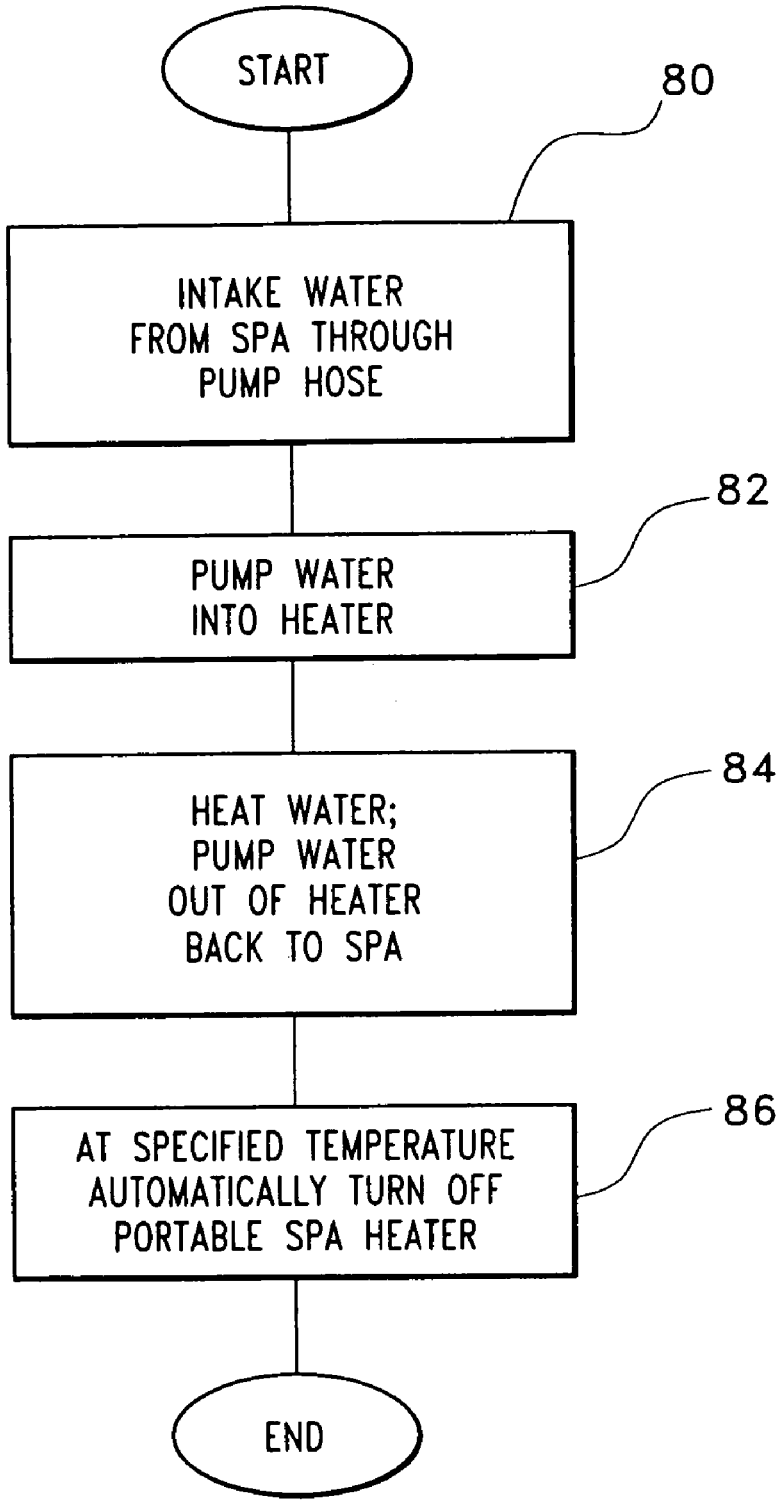
FIG. 3 is a flow chart of a method of reheating a spa according to the present invention.

FIG. 3 is a flow chart showing the method of reheating a spa. At step 80, water is taken in from the spa 100 through the water intake hose 20. The water is pumped into the heater 14, as indicated at step 82. At step 84, the water is heated within the heater 14 and flows back out from the portable spa heating system 10 through the water outlet hose 22. Once a specified temperature is reached by the heater 14, the heater 14 turns off at step 86. The heater 14 may be set in such a manner than the heater 14 is not turned off, but instead maintains the temperature of the water at a constant temperature once the predetermined constant temperature is reached.

The portable spa heater 10 may operate on the spa's 220-volt power supply to take advantage of an existing GFCI outlet, or may operate from a 120-volt power outlet if a GFCI breaker is installed within the housing.

It is to be understood that the present invention is not limited to the embodiment described above, but encompasses any and all embodiments within the scope of the following claims.

I claim:

1. A portable heater unit for heating water contained in a water reservoir of a spa, said portable heater unit consisting of:

a housing;

a carrying handle affixed atop the housing;

an electric heater disposed within the housing;

an electrically connected thermostat assembly disposed within the housing for regulating the temperature of water flowing out of the heater, said thermostat assembly including a dial-type regulator externally disposed on the housing for adjusting the outflow water temperature from the heater and a display external of the housing for displaying the outflow water temperature from the heater;

a pump disposed within the housing;

an electric cord and male plug for connecting said pump and heater to a source of electricity;

a water conduit at a discharge end of the pump for flowing water through the heater;

a water intake hose extending between the pump and the spa for pumping water out of the water reservoir of the spa;

water flow sensors interposed on the water conduit at the discharge end of the pump;

light indicators attached to the housing and electrically connected to the water flow sensors for indicating water flow status; and a water outlet hose extending from the heater to the spa for returning water to the spa;

whereby, the portable heater unit regulates water temperature and monitors water flow as water is drawn from the water reservoir of the spa through the water intake hose and circulated from the pump to the water heater, wherein the water is heated and discharged through a water outlet hose then circulated back into the spa water reservoir.

2. A portable heater unit according to claim 1, wherein the housing is made from a material selected for the group consisting of plastic, aluminum and metal.

* * * * *